United States Patent [19]

Bright

[11] Patent Number: 4,928,414

[45] Date of Patent: May 29, 1990

[54] SELF LUMINOUS CHARACTERS AND SIGNS INCORPORATING SAME

[75] Inventor: Alfred N. Bright, Marlow, England

[73] Assignee: Saunders-Roe Development Limited, Middlesex, United Kingdom

[21] Appl. No.: 267,436

[22] Filed: Nov. 4, 1988

[30] Foreign Application Priority Data

Nov. 5, 1987 [GB] United Kingdom ..... 8725925

[51] Int. Cl.[5] ..... G09F 13/28

[52] U.S. Cl. ..... 40/551; 40/545

[58] Field of Search ..... 40/542, 550, 551, 552, 40/570, 596, 545

[56] References Cited

U.S. PATENT DOCUMENTS 1,743,569 1/1930 Purdow ..... 40/545

2,923,080 2/1960 Spangler ..... 40/552

3,005,102 10/1961 MacHutchin et al. ..... 362/84

3,402,492 9/1968 Clapham, Jr. ..... 40/546

FOREIGN PATENT DOCUMENTS 2203277 10/1988 United Kingdom ..... 40/570

*Primary Examiner*—Cary E. Stone

*Attorney, Agent, or Firm*—Larson and Taylor

[57] ABSTRACT

A self luminous character comprises a transparent light carrier having a plan shape defining the desired shape of the character and includes a longitudinally extending recess housing one or more self luminous light sources. Light from the or each light source diffuses through the transparent light carrier and is reflected by reflector means to be emitted through a front surface of the carrier and illuminate the plan shape of the character.

7 Claims, 1 Drawing Sheet

SELF LUMINOUS CHARACTERS AND SIGNS INCORPORATING SAME

Figure 1:
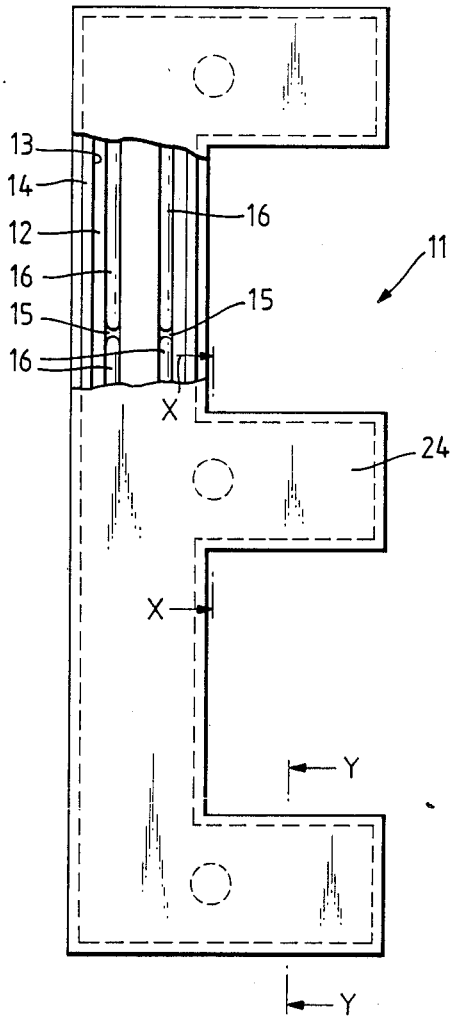

This invention relates to self luminous characters and signs incorporating same.

More particularly the invention is concerned with such characters which employ self luminous light sources of the type where a phosphor coating within a translucent envelope is excited to luminescence by a gaseous radionucleide such as tritium. Such light sources are manufactured by the applicants under the Trademark "Betalight".

In this specification the term character is intended to mean any letter, numeral, symbol or pattern which may be used either individually or, in combination, to construct self powered illuminated signs, for example emergency EXIT signs.

A wide range of such signs currently manufactured by applicants utilize a reflector assembly located in a housing, the reflector being formed with depressions having a parabolic cross sectional shape outlining the shape of all of the characters of the sign. Self luminous light sources are supported at the optical centre along the reflector depressions.

The form of characters used in emergency signs is defined by British Standards and in one case requires a character width of 19 mm. In order to obtain efficient "flashing" of the surfaces of the parabolic reflector in the above referenced signs, this requirement dictates the use of self luminous light sources having a minimum diameter of 5 mm. It will be apparent that the larger the diameter of light source the greater is the quantity of costly radioactive gas required to provide the desired light intensity and, for example, a typical EXIT sign having a 10 year life requires eight Curie.

A diffuser is located above the reflector assembly and the use of a parabolic cross section reflector means that the width at the lip of the section is greater than the required width of the character (e.g. 19 mm), and a stencilled mask is used above the diffuser to define the character width and mask the dark areas along the lip regions of the parabolic cross section reflectors.

The diffuser and stencilled mask are retained by a bezel which is bonded to the housing, and the assembly may be considered rather complex and consequently costly.

It is therefore an object of this invention to provide a self luminous character as hereinbefore defined in which the quantity of radioactive gas is substantially reduced and which can be used to construct self luminous displays simply and economically.

Accordingly, in one aspect this invention provides a self luminous character comprising a transparent light carrier having a plan shape defining substantially the desired shape of the character, at least one longitudinally light source located in the recess, and reflector means, whereby light emitted by the light source diffuses through the transparent carrier and is reflected by the reflector means to be emitted through the front surface of the carrier to illuminate the plan shape of the character.

The or each recess may be formed in the front surface of the carrier and in one embodiment may be located at the bottom of a channel formed in the front surface of the light carrier.

Diffuser means may be attached over the front surface of the light carrier.

The reflector means may comprise a coating of reflective paint.

In one embodiment of the invention the light carrier may be generally rectangular in cross section and said reflector means may be provided on side and rear surfaces of the light carrier. The reflector means may comprise a reflector housing having reflective interal surfaces for location around the side and rear surfaces of the light carrier. In such an embodiment attachment means may be provided for attaching the light carrier to the reflector and may comprise at least one headed stud protruding from the rear surface of the light carrier for location through a mating hole in an internal web of the reflector.

Further attachment means may be provided for attaching the reflector to a support structure and may comprise screw holes in said internal web, In another aspect the invention provides an illuminated sign comprising at least one self luminous character constructed as hereinbefore set forth.

Figure 2:
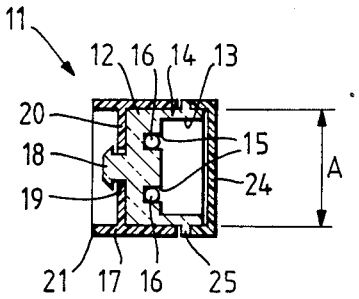
Figure 3:
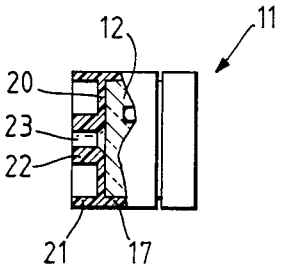

The invention will now be described by way of example only and with reference to the accompanying drawings in which, FIG. 1 is a part sectioned plan view of a self luminous character constructed in accordance with the invention, FIG. 2 is a sectioned view taken on lines X—X of FIG. 1, and FIG. 3 is a part sectioned view taken on lines Y—Y of FIG. 1.

An illuminated character 11 illustrated in the form of a capital letter E suitable for use in a self luminous EXIT sign includes an injection moulded transparent acrylic light carrier 12 having a plan shape defining the shape of a capital letter E.

The carrier is generally rectangular in cross section and a channel 13 formed in a front surface provides a continuous upstanding boundary edge 14. The width 'A' of carrier 12 corresponds to the required illuminated width of the character 11.

Two longitudinally extending recesses 15 are formed in the front surface of the carrier 12 which, in the illustrated embodiment, comprises the surface at the bottom of the channel 13. Each recess 15 contains a plurality of straight miniature self luminous light sources 16 arranged end to end.

An injection moulded white acrylic reflector housing 17 locates around side and rear surfaces of the light carrier 12 and is retained by three integral headed studs 18 (FIG. 2) protruding from the rear surface of the carrier 12 and located through mating apertures 19 in an internal web 20 of the reflector 17. A rearwardly extending continuous wall portion 21 is formed integral with the reflector 17 and is slightly longer than the protruding length of the studs 18.

Referring now to FIG. 3, an integral boss 22 protrudes rearwardly from the internal web 20 of reflector body 17 and is the same length as the wall 21. A central aperture 23 through boss 22 facilitates attachment of the reflector body 17 as hereinafter described.

A combined cover and diffuser device 24 is attached over the entire front surface of the character 11 and is located against an outwardly protruding flange 25 formed integral with carrier 12.

Light from the plurality of light sources 16 diffuses through the transparent light carrier 12 and is reflected by the reflector 17 to be emitted through the front surface of the carrier 12 and the cover/diffuser 20 so as to illuminate the plan shape of the character 11. The arrangement provides an even light output and the width of the visible light defining the character 11 is defined by the width 'A' of the light carrier 12 which can be selected to meet the requirements of any specification.

The use of the miniature light sources 16 which can have a diameter of about 2 mm and a length of 22 mm substantially reduces the amount of radioactive gas required to effectively illuminate the character 11 and, consequently, an illuminated sign using such characters. For example, an EXIT sign with a 10 year life and constructed using characters according to this invention contains a total of about 4.8 Curie of radioactive gas compared to the eight Curie of the existing sign.

In the illustrated embodiment it is envisaged that the light reflecting body 17 of each character 11 in a sign would first be secured such as by a screw through each attachment boss 22 (one only being shown) to a support structure which may be a wall or other surface on which the sign is to be sited, or on to a baseplate or boxtype frame which in turn is secured to the support structure. In either case the assembled light carriers 12 for the individual characters 11 are then located and retained in the reflector body 17 by insertion of the headed studs 18 through the apertures in the internal wall of the body 17.

Thus, the individually illuminated characters 11 of this invention use a very small quantity of radioactive gas and represent a very versatile method of constructing any desired self luminous sign that is very simple to construct and therefore economical.

Whilst one embodiment of the invention has been described and illustrated it will be understood that many modifications may be made without departing from the scope of the invention. For example the channel 13 could be dispensed with and the light sources 16 located at the bottom of deeper recesses 15. The reflector device 17 may be of any suitable material such as aluminum which is provided with a reflective internal surface or, alternatively, may comprise simply a coat of reflective e.g. white, paint, on the side and rear surfaces of the light carrier 12. The light carrier 12 may be of any suitable cross sectional shape having a generally planar front surface, for example semi-circular, and any suitable means may be used to attach the light carrier 12 to the reflector 17 and to attach the reflector 17 to a support structure. The use of the short, straight small diameter light sources 16 means that similar light sources can be used in characters having a curved outline shape such as the letter 'S' however, alternatively, curved small diameter light sources could be used.

What is claimed is:

1. A self-luminous character including a transparent light carrier having a plan shape defining substantially the desired shape of the character, a channel formed in a front surface of the light carrier, at least one longitudinally extending recess in the carrier located at the bottom of said channel, at least one self luminous light source located in said recess, and reflector means, whereby light emitted by the light source diffuses through the transparent carrier and is reflected by the reflector means to be emitted through the front surface of the carrier and illuminate the plan shape of the character.

2. A character as claimed in claim 1, and including diffuser means attached over the front surface of the light carrier.

3. A character as claimed in claim 1, wherein the reflector means comprises reflective paint.

4. A character as claimed in claim 1, wherein the light carrier is generally rectangular in cross section and said reflector means is provided on side and rear surfaces of the light carrier.

5. A character as claimed in claim 4, wherein the reflector means comprises a reflector housing having reflective internal surfaces for location around the side and rear surfaces of the light carrier.

6. A character as claimed in claim 5, and including attachment means for attaching the light carrier to the reflector housing, said attachment means comprising at least one headed stud protruding from the rear surface of the light carrier for location through a mating hole in an internal web of the reflector housing.

7. A character as claimed in claim 6, wherein additional holes through the internal web of the reflector housing provides for attachment of the character to a support structure.

* * * * *